US009797677B2

(12) United States Patent
Willett

(10) Patent No.: US 9,797,677 B2
(45) Date of Patent: Oct. 24, 2017

(54) COMPRESSED GAS CANNON SYSTEM AND METHOD OF MANUFACTURING AND USE THEREOF

(71) Applicant: Michael Willett, Dacula, GA (US)

(72) Inventor: Michael Willett, Dacula, GA (US)

( * ) Notice: Subject to any disclaimer, the term of this patent is extended or adjusted under 35 U.S.C. 154(b) by 31 days.

(21) Appl. No.: 14/446,818

(22) Filed: Jul. 30, 2014

(65) Prior Publication Data

US 2015/0034062 A1 Feb. 5, 2015

Related U.S. Application Data

(60) Provisional application No. 61/861,571, filed on Aug. 2, 2013.

(51) Int. Cl.

| | |
|---|---|
| ***F41B 11/62*** | (2013.01) |
| ***F41B 11/71*** | (2013.01) |
| ***F41B 11/81*** | (2013.01) |
| ***F41B 11/723*** | (2013.01) |

(52) U.S. Cl.

CPC ..... *F41B 11/62* (2013.01); *F41B 11/71* (2013.01); *F41B 11/723* (2013.01); *F41B 11/81* (2013.01)

(58) Field of Classification Search

CPC ..... F41B 11/60; F41B 11/62; F41B 11/72; F41B 11/723; F41B 11/00; F41F 1/06; F41A 27/00

USPC ..... 124/71–77; 89/37.05; 42/94

See application file for complete search history.

(56) References Cited

U.S. PATENT DOCUMENTS 605,841 A * 6/1898 Bates ..... F41B 11/72 124/77
843,573 A * 2/1907 Blomen et al. ..... F41B 11/72 124/69
884,024 A * 4/1908 Lake ..... F41B 11/72 124/73
1,026,303 A * 5/1912 Dickey ..... F41B 11/72 124/40
1,183,644 A * 5/1916 Hill ..... F41B 11/72 124/75
1,299,901 A * 4/1919 Blair ..... F41B 11/72 124/50
2,383,087 A * 8/1945 Shaffer ..... F41F 1/06 42/72
2,451,524 A * 10/1948 Walker ..... F41F 1/06 89/1.35
2,518,452 A * 8/1950 Davis, Jr. ..... F41F 1/06 248/411
2,525,082 A * 10/1950 Sherman ..... F41B 11/00 124/50
2,809,624 A * 10/1957 Becher ..... F41A 33/00 124/77
2,886,025 A * 5/1959 Henry ..... F41A 19/58 124/77
2,955,585 A * 10/1960 Friedland ..... F41A 21/10 124/73
2,960,083 A * 11/1960 Grimland ..... F16K 31/003 124/73

(Continued)

*Primary Examiner* — Jonathan C Weber

(74) *Attorney, Agent, or Firm* — Benjamin A. Balser; Next IP Law Group

(57) ABSTRACT

A compressed air cannon includes a launch pipe and a gas tube. The launch pipe has a closed end and an open end. The gas tube is into the top of the launch pipe, where the gas tube has an outlet directed toward the closed end of the launch pipe.

10 Claims, 6 Drawing Sheets

(56) References Cited

U.S. PATENT DOCUMENTS

| | | | | |
|---|---|---|---|---|
| 3,041,938 | A * | 7/1962 | Seabrook | F41A 23/16 42/94 |
| 4,012,986 | A * | 3/1977 | Germershausen | F41A 1/08 89/1.35 |
| 2005/0011507 | A1* | 1/2005 | Webb | F41B 11/62 124/71 |
| 2005/0188977 | A1* | 9/2005 | Wygant | A63B 69/409 124/73 |

* cited by examiner

COMPRESSED GAS CANNON SYSTEM AND METHOD OF MANUFACTURING AND USE THEREOF

TECHNICAL FIELD

The present disclosure is generally related to special effects systems and, more particularly, is related to devices for launching paint, confetti, other items, and the like into the air, also known as compressed gas cannons or paint cannons.

BACKGROUND

Paint, confetti, other items, or the like are often used at the beginning or during party events and/or celebrations, like paint parties, or other desired locations, events, the like, etc. Paint parties are a relatively new celebration and are usually thrown with music and special effects where people enjoy the wet and wild feeling associated with paint being spayed all over their bodies. The paint (for example neon paint) used is completely water soluble, non toxic, non allergenic and washes off very easily with water. Paint, confetti, other objects, or the like, may be sprayed from an elevated position or shot, blasted or burst out of a compressed air cannon, like a paint cannon.

Bursts of paint, confetti, other objects, or the like, are becoming more and more popular at shows, parties (like paint parties), circus acts and other events so as to produce displays of sound, color, and motion. However, current compressed air cannons are rather large or bulky and made of two or more parts or pieces that need to be attached or assembled together. For example, current compressed air cannons typically require a separate valve to be hooked up to it for regulating the compressed gas. As such, these compressed air cannons are difficult to transport, time consuming to setup and/or tear down, and limited to wear they can be placed, positioned and/or mounted.

Compressed air cannons typically shoot the paint, confetti, other objects, or the like by releasing the compressed air into the cannon. The typical power of the cannons may be inadequate for the distance they can shoot and the amount of material that can be shot in a given amount of time. As such, it should be readily apparent by those skilled in the special effects art that more powerful cannons that could fire materials farther and fire more material in a shorter amount of time is desired. For example, for paint parties which may include thousands of patrons, it may be more desired to provide a cannon for shooting paint at large distances and/or with large amounts of paint being shot in short amounts of time.

Compressed air cannons typically have a manual valve, like a ball valve, that is connected to a pressurized $CO_2$ tank for controlling the flow of gas into the cannon, i.e. the firing of the paint. These manual valves require an operator to fire the cannon by manually opening the valve in proximity to the device. This further limits the locations the cannon can be placed or positioned and requires an operator to be present at the cannon for firing. As such, it should be readily appreciated by those skilled in the special effects art that a cannon that could be remotely fired would allow for easier operation and allow the cannon device to be positioned in more optimal locations.

Therefore, it is readily apparent that there is a recognizable unmet need for a compressed air cannon, like a paint cannon device, that is compact, easy to transport, easy to setup and/or tear down, capable of being placed, positioned, and or mounted in more desired locations, more powerful, capable of firing more material in a shorter amount of time, and capable of being remotely fired.

The instant disclosure of a compressed air cannon and method of manufacture and use thereof may be provided to address at least some of the above mentioned problems.

SUMMARY

Briefly described, in a preferred embodiment, the present apparatus and method overcomes the above-mentioned disadvantages and meets the recognized need for such a device by providing a compressed air cannon device for shooting, bursting or blasting paint, confetti, other objects, or the like that may be compact, may be easy to transport, may be easy to setup and/or tear down, may be powerful, may be capable of firing more material in a shorter amount of time, and/or may be capable of being placed, positioned, and or mounted in various desired locations.

In general, the compressed air cannon device of the instant disclosure may include a launch pipe with a gas tube. The launch pipe may have a closed end and an open end. The gas tube may be positioned into a top of the launch pipe, where the gas tube may have an outlet directed toward the closed end of the launch pipe. In one embodiment, the gas tube may have a 90 degree bend from the top of the launch pipe to direct the outlet toward the closed end of the launch pipe. The gas tube may be positioned with the outlet above the material line thereby allowing for compressed air to enter the launch pipe at a maximum speed. As such, the gas tube may be positioned on the top of the launch pipe approximate the open end of the launch pipe.

One feature may the inclusion of a valve module positioned on the launch pipe and in communication with the gas tube for controlling the entrance of compressed air into the launch pipe and out of the outlet toward the closed end of the launch pipe.

In one embodiment, the valve module and the launch pipe may be integrally formed as a one-piece housing.

One feature of the valve module may be the inclusion of an internal valve that may be an electric solenoid valve for controlling the compressed air cannon remotely. In one embodiment, the electric solenoid valve may be a normally closed valve that opens when powered allowing for remote firing of the compressed air cannon via an activator. The activator may be wired activators and/or wireless activators. In one embodiment, the electric solenoid valve may allow for remote firing of the compressed air cannon via the activator controlled by a standard DMX controller to signal the compressed air cannon to blast. In another embodiment, the electric solenoid valve may allow for remote firing of the compressed air cannon via a push button firing system.

Another feature of the valve module may be the inclusion of a compressed gas inlet in communication with the gas tube, whereby the valve module controls the compressed gas moving from the compressed gas inlet into the gas tube.

One feature of the compressed air cannon may be that the gas inlet may be operable to connect a pressurized $CO_2$ tank to the valve module and the gas tube. Whereby, the compressed air cannon may be operable by filling with material and connecting the pressurized $CO_2$ tank.

Another feature of the compressed air cannon may be the inclusion of a stand for positioning the launch pipe at various launch angles to the stand, and/or for positioning the compressed air cannon in various locations or to various objects. In one embodiment, the stand may include an I-shaped base.

One feature of the stand may be the inclusion of an adjustable elevation arm interconnecting the stand with the launch pipe. The adjustable elevation arm may include a lower arm and an upper arm telescopically connected. In one embodiment, the lower arm and the upper arm may include a plurality of adjustment holes for adjusting the launch pipe at various launch angles.

One feature of the adjustable elevation arm may be the ability to allow the launch pipe to adjust from 10 degrees up to 60 degrees.

Another feature of the stand may be the inclusion of a plurality of mounting holes approximate to each corner of the stand for securing the compressed air cannon in various locations or to various objects.

Another feature of the compressed air cannon may the optional auto refill assembly. In one embodiment, the auto refill assembly may include a material inlet positioned approximate the closed end of the launch pipe, a 90 degree fitting from the material inlet to divert flow to the closed end of the launch pipe, a submersible pump, and a material tube with a quick connect fitting from the material inlet to the submersible pump. Whereby, the launch pipe may be automatically refilled by inserting the submersible pump into a material reservoir.

Another feature of the compressed air cannon may be that it can be a paint cannon. The compressed air cannon may be operable as a paint cannon by filling with paint and connecting a pressurized CO2 tank to the internal valve. One feature of the paint cannon is that it may be adapted to shoot paint at distances from 20 feet out to 75 feet depending on the angle of launch. Another feature of the paint cannon may be that it can be adapted to shoot out 1.5 gallons of paint in 1 second.

In use, a method of launching paint into the air may be conducted utilizing the various embodiments of the paint cannon as shown and described herein. The method may include the general steps of: providing the paint cannon in any of the various embodiments shown and described herein including a launch pipe having a closed end and an open end, and a gas tube into the top of the launch pipe, where the gas tube has an outlet directed toward the closed end of the launch pipe; connecting a pressurized $CO_2$ tank to the gas tube; and firing the paint cannon.

One feature of the method of launching paint into the air may be where the provided paint cannon may include a valve module positioned on the launch pipe and in communication with the gas tube for controlling the entrance of compressed air into the launch pipe and out of the outlet toward the closed end of the launch pipe, wherein the valve module including an internal valve that may be an electric solenoid valve for controlling the compressed air cannon remotely via an activator, whereby, the step of firing the paint cannon may include a step of remotely firing of the paint cannon via the activator.

Another feature of the method of remotely launching paint into the air may be when the provided paint cannon may include a stand for positioning a launch pipe at various launch angles, whereby the method further may include the step of positioning the launch pipe at a desired launch angle via the stand.

Another feature of the method of remotely launching paint into the air may be when the stand may be for securing the paint cannon in various locations or to various objects, whereby the method may further include the step of attaching the stand in a desired location or to a desired object.

BRIEF DESCRIPTION OF THE DRAWINGS

The present paint cannon will be better understood by reading the Detailed Description with reference to the accompanying drawings, which are not necessarily drawn to scale, and in which like reference numerals denote similar structure and refer to like elements throughout, and in which.

DETAILED DESCRIPTION

Figure 1:
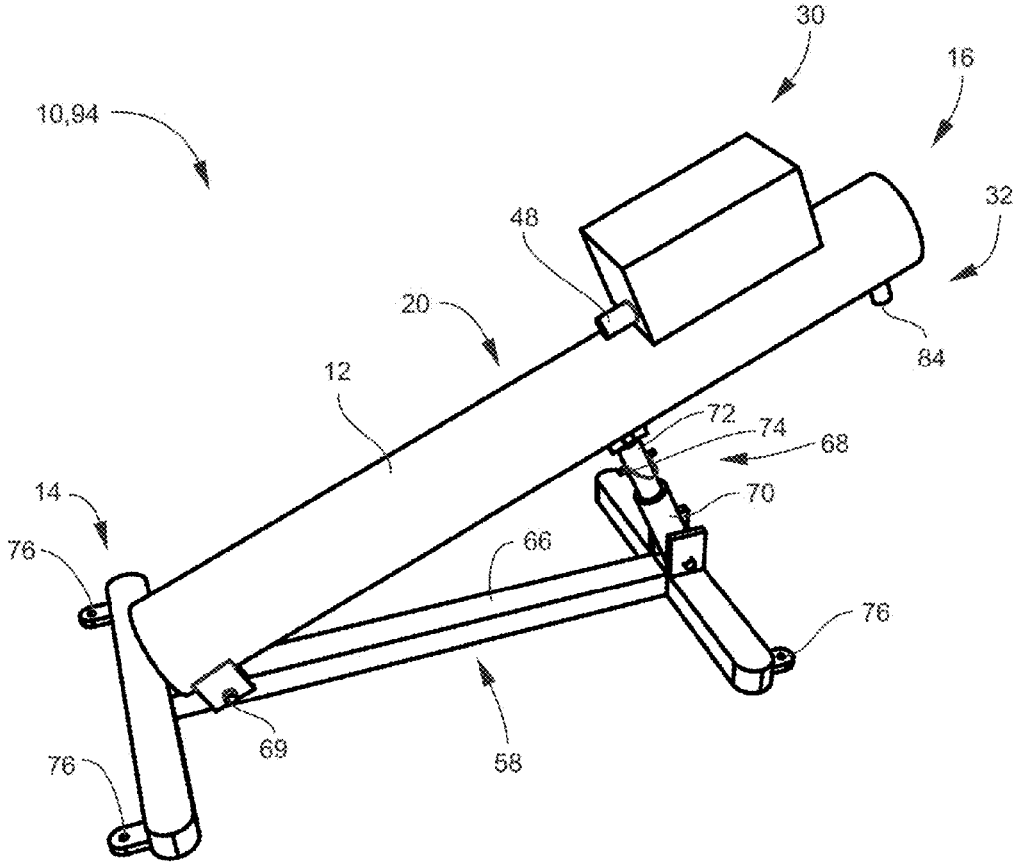
FIG. 1 is a perspective view of an example embodiment of a compressed air cannon or paint cannon.

In describing the exemplary embodiments of the present disclosure, as illustrated in FIGS. 1-7, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-6 by way of example, and not limitation, therein is illustrated example embodiments of compressed air cannon 10 or paint cannon 94 for firing, shooting, bursting, or blasting materials 11, like paint 96, confetti, other materials, or the like. The materials 11 fired by cannon 10, as used herein, may refer to paint 96, like neon paint, other liquids or the like, but is not limited thereto, and may also be used for firing confetti, streamers, rose pedals, tickets, money, and/or the like. As shown therein, compressed air cannon 10 or paint cannon 94 generally includes launch pipe 12 having closed end 14 and open end 16. Gas tube 18 may be into top 20 of launch pipe 12, where gas tube 18 may have outlet 22 directed toward closed end 14 of launch pipe 12. In one embodiment, gas tube 18 may have 90 degree bend 24 from top 20 of launch pipe 12 to direct outlet 22 toward closed end 14 of launch pipe 12. Gas tube 18 may be positioned with the outlet above material line 26 thereby allowing for compressed air 28 to enter launch pipe 12 at a maximum speed. In one embodiment, gas tube 18 may be positioned on top 20 of launch pipe 12 approximate open end 16 of launch pipe 12.

Figure 2:
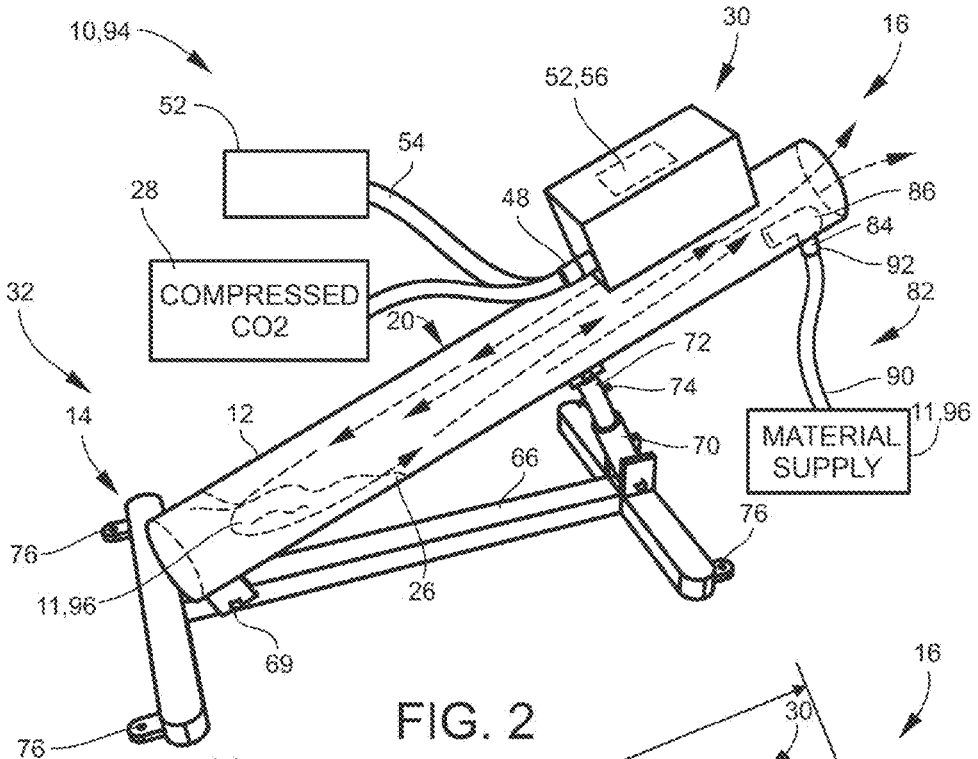
FIG. 2 is another perspective view with an internal flow diagram of the compressed air cannon device or paint cannon device of FIG. 1.
Figure 3:
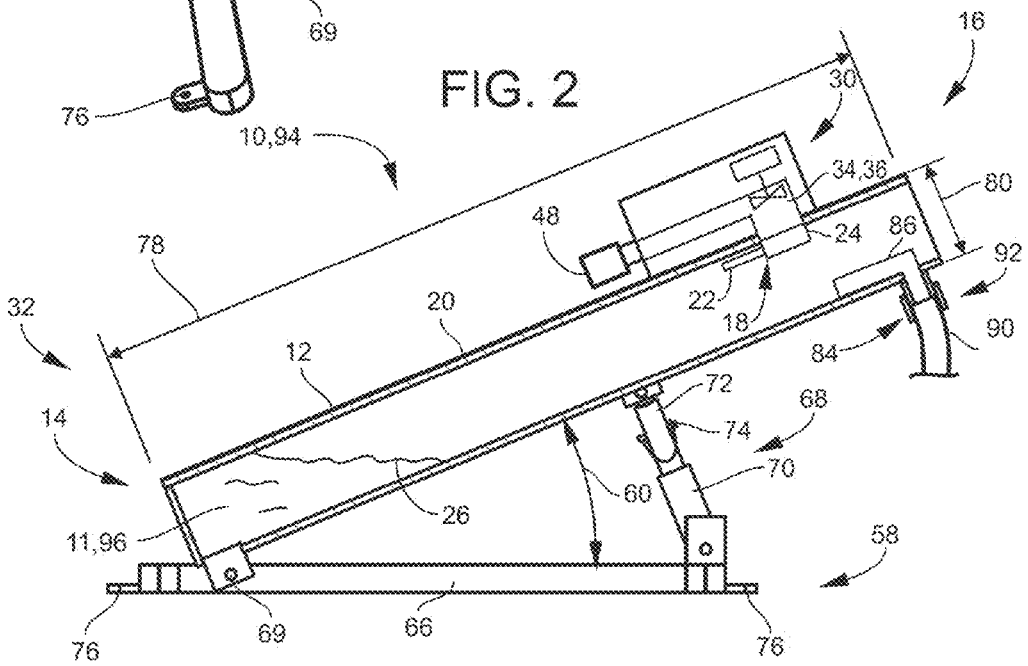
FIG. 3 is a cross-sectional diagram of the compressed air cannon device or paint cannon device of FIG. 1.
Figure 4A:
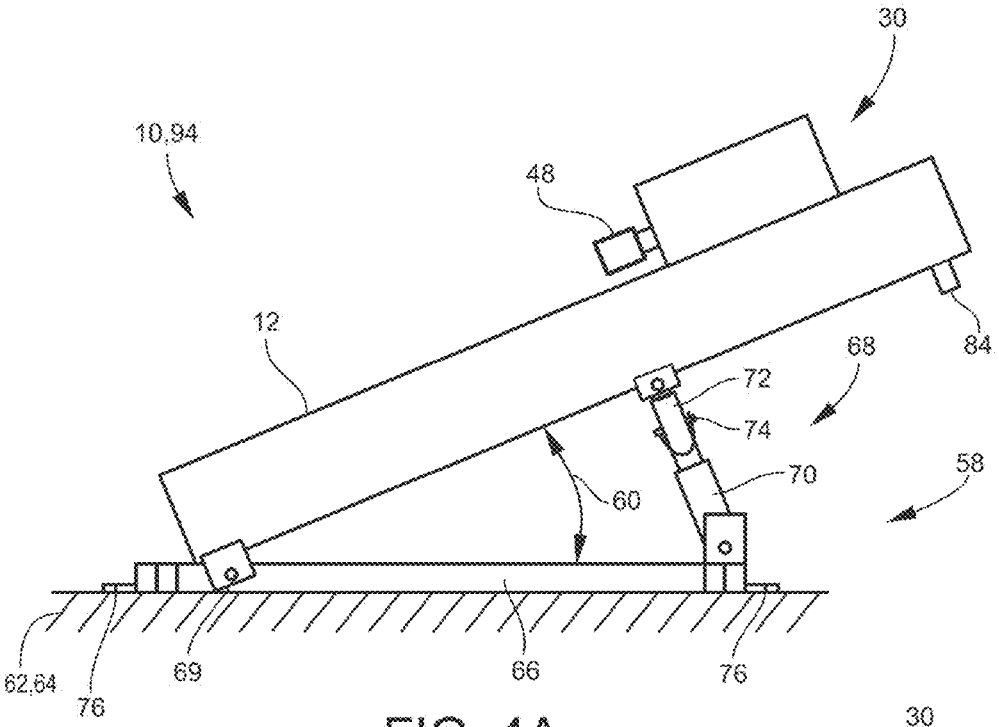
FIG. 4A is a side view of the compressed air cannon device or paint cannon device of FIG. 1 in a raised firing position.
Figure 4B:
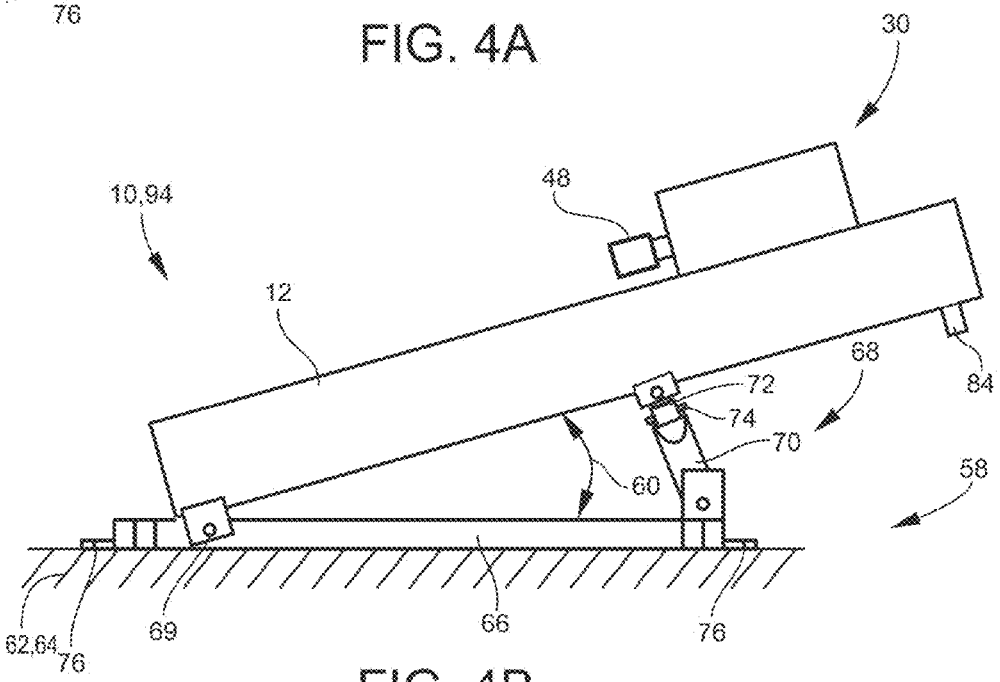
FIG. 4B is another view of the compressed air cannon device or paint cannon device of FIG. 1 in a lowered firing position.
Figure 5:
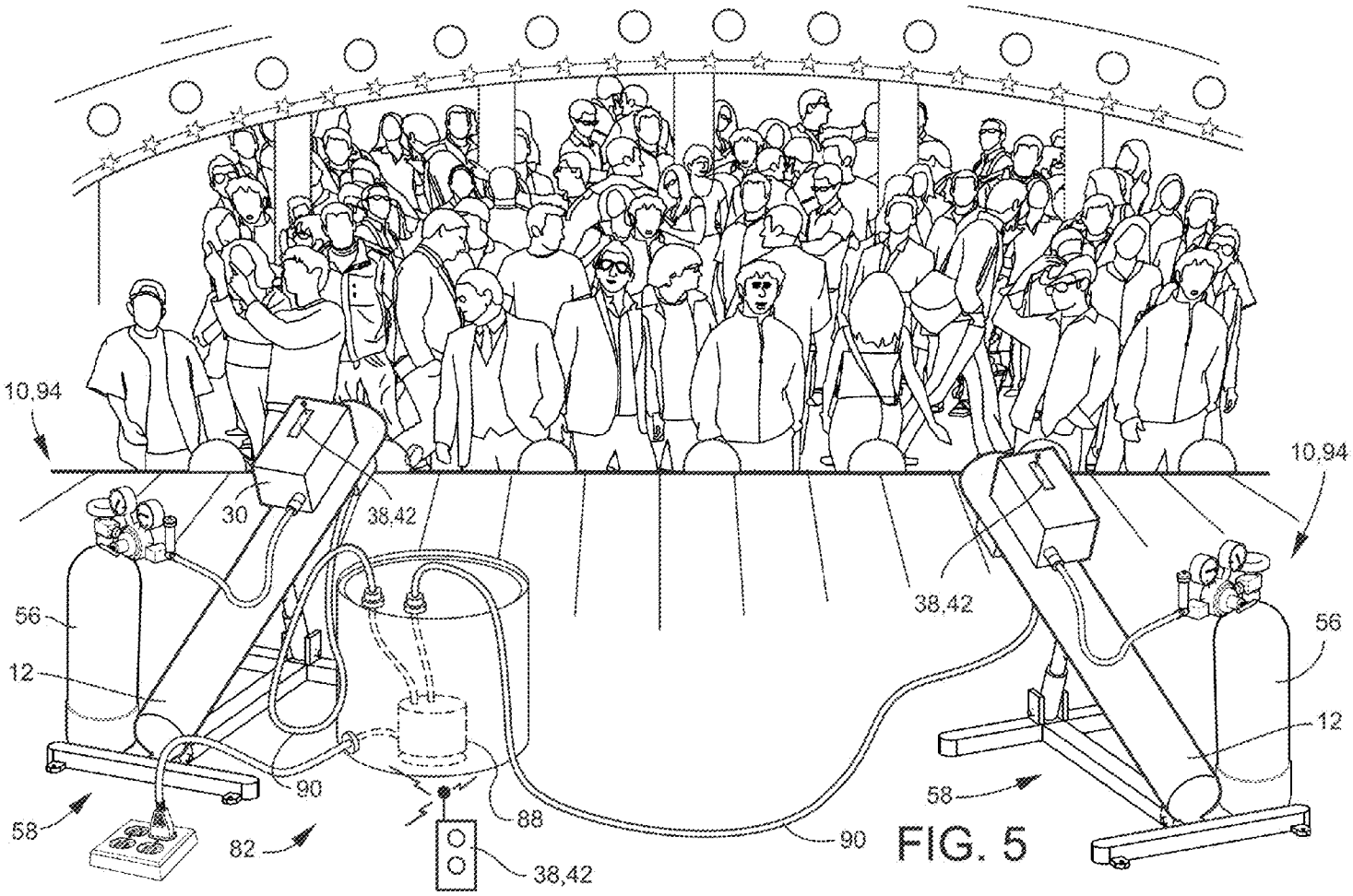
FIG. 5 is an environmental perspective view of multiple embodiments of the compressed air cannon devices or paint cannon devices with wireless activators mounted in various locations at a paint party.
Figure 6:
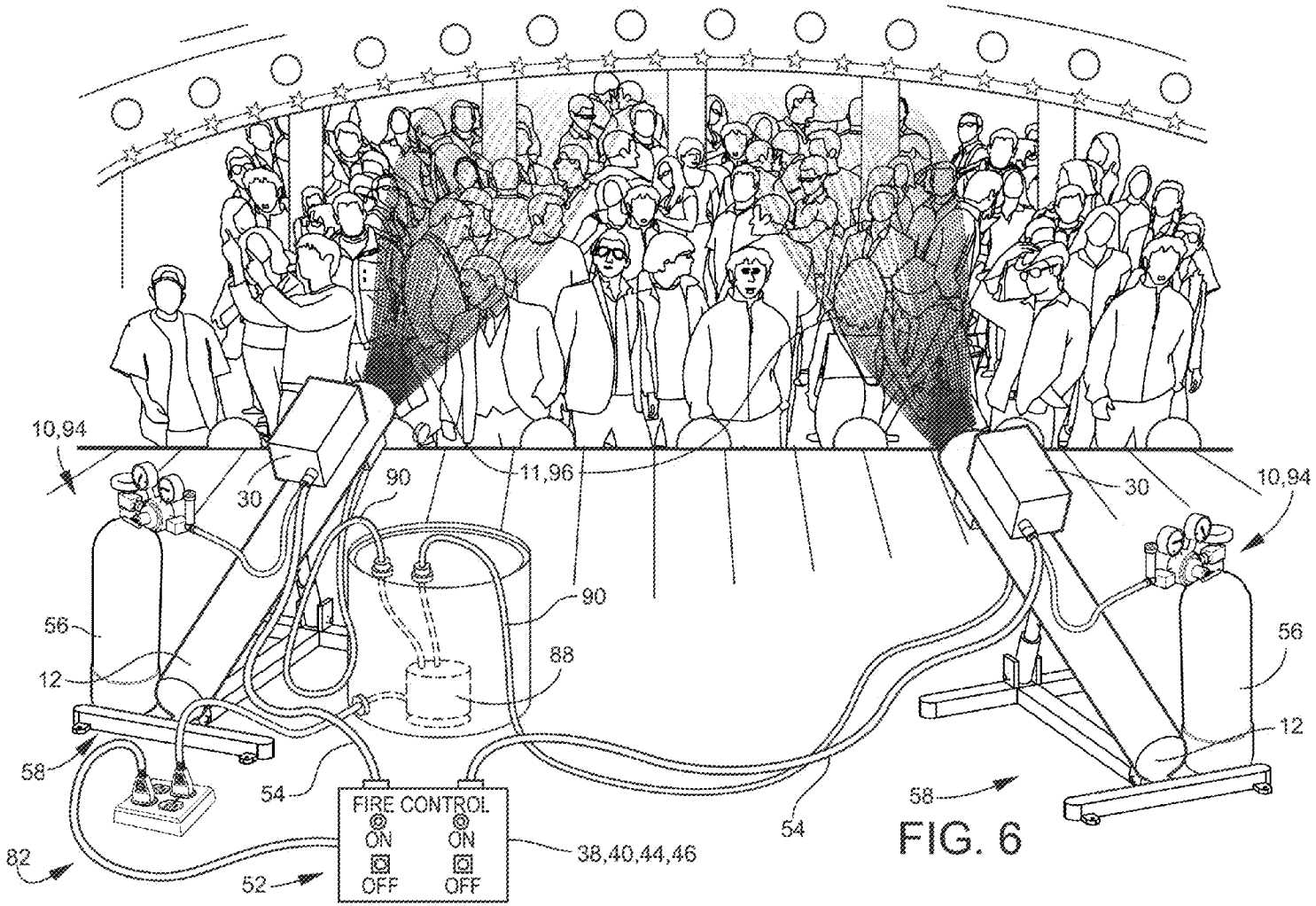
FIG. 6 is an environmental perspective view of multiple embodiments of the compressed air cannon devices or paint cannon devices with a wired activator mounted in various locations at a paint party firing material or paint.
Figure 7:
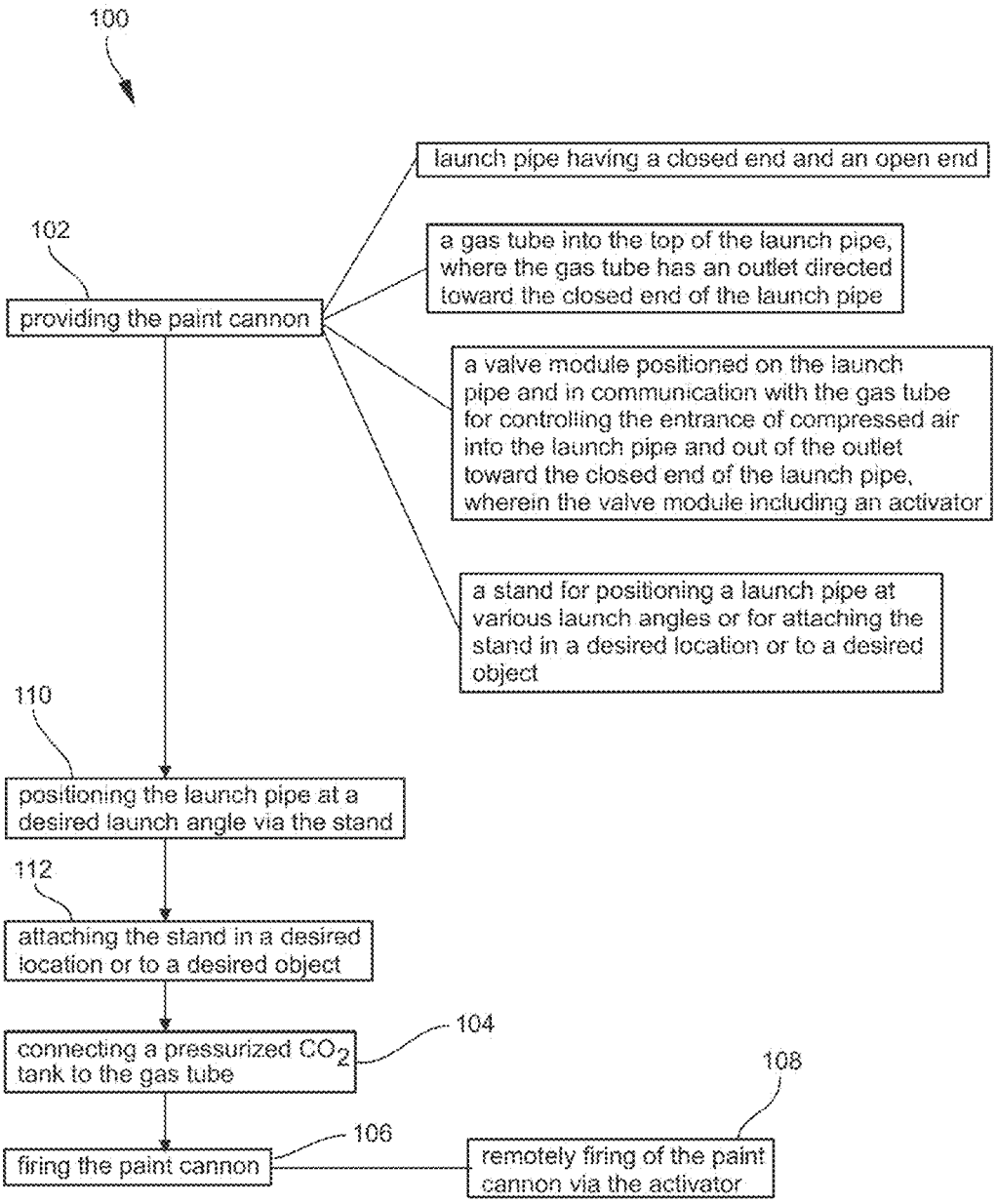
FIG. 7 is a flow chart depicting an exemplary embodiment of the method of launching paint into the air.

Referring to FIGS. 2-3, in operation compressed gas 28, like compressed $CO_2$, may enter gas tube 18 and move out of outlet 22. The 90 degree bend 24 may direct the flow of compressed gas 28 from outlet 22 toward closed end 14 of launch pipe 12. Because outlet 22 of gas tube 18 may be above or outside of material line 26, compressed gas 28 may enter launch pipe 12 at a maximum speed. Once compressed gas 28 enters launch pipe 12 it may contact material line 26 of material 11 or paint 96 and do a u-turn, or 180 degree turn approximate to closed end 14 and be redirected toward open end 16 of launch pipe 12. One unique feature on this cannon may be the directing of compressed air 28 backwards along top 20 of launch pipe 12, keeping outlet 22 above material line 26. This gives the air enough time to reach max speed before contacting material 11 or paint 96 where the flow then travels along top 20 toward closed end 14 to where it hits the back of launch pipe 12 and makes a u-turn. This u-turn may be where you get your compression from causing paint 96 or other material 11 to project out of cannon 10 or 94 in a stream. As such, this feature of introducing compressed gas 28 at a maximum speed toward the closed end 14 of launch pipe 12 may provide the increased force or power to shoot, launch or fire material 11 or paint 96 out of open end 16 of launch pipe 12. In one embodiment, compressed air cannon 10 or paint cannon 94 may shoot paint at distances from 20 feet out to 75 feet depending on the angle of launch. In another embodiment, compressed air cannon 10 or paint cannon 94 may shoot out 1.5 gallons of paint in 1 second.

Cannon 10 or 94 may use compressed $CO_2$ because it may be pressurized at 850 psi which may provide extreme pressure through the system and is instant. In addition, it is also extremely cold causing a cooling effect in the liquid during hot summertime parties which is the most popular time for paint parties.

In select embodiments, compressed air cannon 10 may also include valve module 30. Valve module 30 may be for controlling the compressed air 28 entered into compressed air cannon 10 via gas tube 18. Valve module 30 may be any device or combination of devices for controlling the compressed air 28 entered into compressed air cannon 10 via gas tube 18. Valve module 30 may be positioned anywhere on launch pipe 12, including, but not limited to over gas tube 18. Valve module 30 may be in communication with gas tube 18 for controlling the entrance of compressed air 28 into launch pipe 12 and out of outlet 22 toward closed end 14 of launch pipe 12.

In one embodiment, valve module 30 may include an internal valve 34. Internal valve 34 may be any valve internal to valve module 30. Internal valve 34 may be for controlling the compressed air 28 entered into compressed air cannon 10 via gas tube 18 from inside valve module 30. Internal valve 34 may be any valve or like device. In select embodiments, internal valve 34 may be an electric solenoid valve 36 for controlling compressed air cannon 10 remotely. In this electric solenoid valve embodiment, electric solenoid valve 36 may be a normally closed valve that opens when powered allowing for remote firing of compressed air cannon 10 via an activator 38. Activator 38 may be any device or combination of devices for remotely activating electric internal valve 34, like remotely activating electric solenoid valve 36. Activator 38 may include wired activators 40 (see FIG. 5), wireless activators 42 (see FIG. 6), the like, or combinations thereof. The wired activators 40 may be any devices for activating internal valve 34 via a wired signal, including, but not limited to, standard DMX controller 44 (like a DMX512 dimmer pack); a power strip; push button systems 46 (like cryo blaster push button systems); a foot switch, the like, or any combinations thereof. In one embodiment, electric solenoid valve 36 may allow for remote firing of compressed air cannon 10 via activator 38 controlled by a standard DMX controller 44 to signal compressed air cannon 10 to blast or fire. DMX controllers may be readily used in the special effects industry, which should allow for easy integration of the remote firing of compressed air cannon 10 or paint cannon 94 into standard special effects controls or modules. For example, in this embodiment, electric solenoid valve 36 may allow for remote firing of air cannon 10 or paint cannon 94 via activator 38 controlled by a DMX512 dimmer pack to signal the cannon to blast. In another embodiment, electric solenoid valve 36 may allow for remote firing of compressed air cannon 10 via a push button firing system 46.

Valve module 30 may include compressed gas inlet 48. Compressed gas inlet 48 may be for providing a means for introducing compressed gas or air 28 into compressed air cannon 10. Compressed gas inlet 48 may be in communication with gas tube 18, whereby valve module 30 may control compressed gas 28 moving from compressed gas inlet 48 into gas tube 18. Compressed gas inlet 48 may be operable to connect pressurized $CO_2$ tank 50 to valve module 30 and gas tube 18. Whereby, compressed air cannon 10 or paint cannon 94 may be operable by filling with material 11, like paint 96, and connecting pressurized $CO_2$ tank 50. Valve module 30 may include power source 52. Power source 52 may be any power source for providing power to valve module 30. Power source 52 may be wired power or it may be wireless power, like via battery 56 (see FIGS. 2 and 5). In the wired embodiment, power source 52 may include power cord 54 extending from valve module 30, which may provide 110 volts or 220 volts of alternating current. In the wireless embodiment, power source 52 may include battery 56, which may be any size battery, including, but not limited to, providing 12 volts or 24 volts of direct current.

In one embodiment, valve module 30 and launch pipe 12 may be integrally formed as one-piece housing 32. One-piece housing 32 may include launch pipe 12, valve module 30, and/or stand 58. Valve module 30 may include compressed gas inlet 48 which may be connected to internal valve 34. Whereby, launch pipe 12, and valve module 30 may be integrally formed to create one-piece housing 32. Integrally formed one-piece housing 32, as used herein, refers to one-piece housing 32 being manufactured or created as a single unit, requiring no assembly by the user. For example, one-piece housing 32 may not require any assembly of launch pipe 12 to valve module 30, and/or may not require any assembly of launch pipe 12 to stand 58. As such, integrally formed one-piece housing 32 may be created by any various integrally forming processes, including, but not limited to, any stamping processes, molding processes, welding processes, the like processes, or any combinations thereof for creating one-piece housing 32. One-piece housing 32 being integrally formed may allow for compressed air cannon 10 to be compact, easy to transport, easy to setup and/or tear down, capable of being placed, positioned, and or mounted in more desired locations, the like, or any combinations thereof.

In select embodiments, compressed air cannon 10 may include stand 58. Stand 58 may be for positioning launch pipe 12 at various launch angles 60 to stand 58 and/or for positioning compressed air cannon 10 in various locations 62 or to various objects 64. Stand 58 may include any device, means, or combination of devices and/or means for positioning launch pipe 12 at various launch angles 60 to stand 58 and/or for positioning compressed air cannon 10 in various locations 62 or to various objects 64. Stand 58 may be any size, shape or material stand for positioning launch pipe 12 at various launch angles 60 to stand 58, and/or for securing paint cannon 10 in various locations 62 or to various objects 64. In one embodiment, as shown in the FIGS., stand 58 may include I-shaped base 66. For stability, stand 58 may be sized larger than launch pipe 12.

In select embodiments of stand 58, adjustable elevation arm 68 may be included along with pivot connection 69. Adjustable elevation arm 68 may be for positioning launch pipe 12 at various launch angles 60 to stand 58. In one embodiment, adjustable elevation arm 68 and pivot connection 69 may interconnect stand 58 with launch pipe 12. Adjustable elevation arm 68 may be any means or may include any devices, or combination of means and devices for positioning launch pipe 12 at various launch angles 60 to stand 58. In one embodiment, adjustable elevation arm 68 may include lower arm 70 and upper arm 72 telescopically connected. Lower arm 70 and upper arm 72 may include a plurality of adjustment holes 74 for adjusting launch pipe 12 at various launch angles 60. A locking means, like a nail, screw, cotter pin, the like, etc. may be utilized with adjustment holes 74 for locking adjustable elevation arm 68 into a desired launch angle 60. Adjustable elevation arm 68 may allow compressed air cannon 10 to be adjusted to any desired launch angle 60. As such, adjustment holes 74 may be placed at any desired intervals on adjustable elevation arm 68 for creating any desired launch angles 60. In one embodiment, adjustable elevation arm 68 may allow launch pipe 12 to adjust from 10 degrees up to 60 degrees.

In select embodiments of stand 58, plurality of mounting holes 76 may be included. Mounting holes 76 may be for positioning compressed air cannon 10 in various locations 62 or to various objects 64. Mounting holes 76 may include any desired number of holes and may be positioned in any desired location on stand 58. In one embodiment, mounting holes 76 may be approximate to each corner of stand 58 for securing compressed air cannon 10 in various locations 62 or to various objects 64.

Compressed air cannon 10 or paint cannon 94 may be provided in any desired length 78 and/or diameter 80 of launch pipe 12. For example, in one embodiment, compressed air cannon 10 may be provided with length 78 being between 24 inches to 30 inches and diameter 80 being approximately 4 inches.

Compressed air cannon 10 or paint cannon 94 may be filled with material 11, like paint 96, by any means. In one embodiment, compressed air cannon 10 may be manually filled by inserting material 11, like paint 96, into open end 16 of launch pipe 12. Launch pipe 12 can be filled all the way up until material 11, like paint 96 either comes out of open end 16 (lower launch angles 60) or comes up to gas tube 18 (higher launch angles 60). In another optional embodiment, compressed air cannon 10 or paint cannon 94 may include auto refill assembly 82 for automatically refilling material 11 or paint 96 into launch pipe 12. Auto refill assembly 82 may include material inlet 84 positioned approximate open end 16 of launch pipe 12. 90 degree fitting 86 may be included from material inlet 84 to divert flow to closed end 14 of launch pipe 12. Submersible pump 88 may be included with auto refill assembly 82 for pumping material 11, like paint 96 or other materials into material inlet 84. Material tube 90 may be included with quick connect fitting 92 for moving material 11 or paint 96 from submersible pump 88 to material inlet 84. Whereby, launch pipe 12 may be automatically refilled by inserting submersible pump 88 into a material reservoir, like a paint bucket.

Referring to FIG. 9, in use, method 100 of launching paint into the air may be accomplished with various embodiments of compressed air cannon 10 or paint cannon 94, as shown and described herein. Method 100 of launching paint into the air may generally include the steps of: step 102 of providing paint cannon 10 or 94 as shown and described herein with launch pipe 12 having closed end 14 and open end 16 and gas tube 18 into top 20 of launch pipe 12, where gas tube 18 has outlet 22 directed toward closed end 14 of launch pipe 12; step 104 of connecting pressurized $CO_2$ tank 50 to gas tube 18; and firing paint cannon 10 or 94.

In one embodiment of method 100, when the provided paint cannon 10 or 94 further comprising valve module 30 positioned on launch pipe 12 and in communication with gas tube 18 for controlling the entrance of compressed air 28 into the launch pipe 12 and out of outlet 22 toward closed end 14 of launch pipe 12, wherein valve module 30 including internal valve 34 being an electric solenoid valve 36 for controlling the paint cannon 10 or 94 remotely via activator 38, step 106 of firing the paint cannon 10 or 94 may include step 108 of remotely firing of the paint cannon 10 or 94 via activator 38.

In another embodiment of method 100, when the provided paint cannon 10 or 94 further comprising stand 58 for positioning launch pipe 12 at various launch angles 60, whereby method 100 may further include step 110 of positioning launch pipe 12 at desired launch angle 60 via stand 58.

In another embodiment of method 100, when stand 58 further being for securing paint cannon 10 or 94 in various locations 62 or to various objects 64, whereby method 100 may further include step 112 of attaching stand 58 in desired location 62 or to desired object 64;

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A compressed air cannon comprising:

a launch pipe configured to contain materials to be launched directly from the launch pipe, having a closed end, an open end, and a sidewall with an interior surface and exterior surface; and a gas tube provided through the sidewall at an entry point of the launch pipe adjacent the open end, the gas tube provided with an outlet adjacent to the entry point into an interior of the launch pipe that is directed toward the closed end of the launch pipe.

2. The compressed air cannon of claim 1 wherein said gas tube having a 90 degree bend from the top of said launch pipe to direct said outlet toward said closed end of said launch pipe, and being positioned on the top of said launch pipe approximate the open end of said launch pipe.

3. The compressed air cannon of claim 1 wherein said gas tube is positioned with the outlet above a material line.

4. The compressed air cannon of claim 1 further comprising a stand for positioning the launch pipe at various launch angles to said stand, for positioning the compressed air cannon in various locations or to various objects, or combinations thereof.

5. The compressed air cannon of claim 4 wherein said stand comprising an adjustable elevation arm interconnecting said stand with said launch pipe.

6. The compressed air cannon of claim 5 wherein said adjustable elevation arm including a lower arm and an upper arm telescopically connected, wherein said lower arm and said upper arm including a plurality of adjustment holes for adjusting said launch pipe at various launch angles;

whereby, said adjustable elevation arm allows said launch pipe to adjust from 10 degrees up to 60 degrees.

7. The compressed air cannon of claim 4 wherein said stand including a plurality of mounting holes approximate to each corner of said stand for securing the compressed air cannon in various locations or to various objects.

8. The compressed air cannon of claim 1 being a paint cannon, wherein said paint cannon:

shoots paint at distances from 20 feet out to 75 feet, shoots out 1.5 gallons of paint in 1 second, or combinations thereof.

9. A paint cannon comprising:

a launch pipe configured to contain materials to be launched directly from the launch pipe, having a closed end, an open end, and a sidewall with an interior surface and exterior surface; and a gas tube provided through the sidewall at an entry point of the launch pipe, the gas tube provided with an outlet adjacent to the entry point into an interior of the launch pipe that is directed toward the closed end of the launch pipe.

10. The paint cannon of claim 9 wherein:

said gas tube having a 90 degree bend from the top of said launch pipe to direct said outlet toward said closed end of said launch pipe;

said gas tube being positioned with the outlet above a material line;

said gas tube being positioned on the top of said launch pipe approximate the open end of said launch pipe; or combinations thereof.

* * * * *